US005387084A

United States Patent [19]

Walberg

[11] Patent Number: 5,387,084

[45] Date of Patent: Feb. 7, 1995

[54] FLAT FOLDING FAN WITH ENVELOPE HANDLE

[76] Inventor: Gretchen G. Walberg, P.O. Box 130, Sunbury, Pa. 17801

[21] Appl. No.: 54,742

[22] Filed: Jun. 16, 1993

[51] Int. Cl.[6] ..... A45B 27/00

[52] U.S. Cl. ..... 416/70 A; 416/71; 416/73; 416/142

[58] Field of Search ..... 416/70 R, 70 A, 71, 416/72, 73, 142

[56] References Cited

U.S. PATENT DOCUMENTS

| | | | |
|---|---|---|---|
| 849,426 | 4/1907 | Reiman . | |
| 922,715 | 5/1909 | Munster . | |
| 1,863,997 | 6/1932 | Riva | 416/73 |
| 2,208,243 | 7/1940 | Bittson | 416/72 |
| 2,346,596 | 4/1944 | Martin | 416/71 |
| 2,449,701 | 9/1948 | Imperial | 416/71 |
| 2,581,643 | 1/1952 | Francis | 416/73 |
| 4,911,611 | 3/1990 | Moore | 416/70 A |

FOREIGN PATENT DOCUMENTS

| | | | |
|---|---|---|---|
| 734173 | 10/1932 | France | 416/72 |

*Primary Examiner*—Edward K. Look
*Assistant Examiner*—James A. Larson
*Attorney, Agent, or Firm*—Hale and Dorr

[57] ABSTRACT

A fan device comprising two flat leaves inseparably attached to a flat hollow handle that serves as an envelope wherein the folded leaves can be tucked away when not in use. The fan opens for use by telescoping the leaves out of the envelope/handle part way, unfolding them, and then inserting side tabs of the leaves into side slots on the envelope/handle. Top center notches on both leaves are then interlocked forming a rigid plane comprising the two leaves joined to each other and to the envelope/handle to become a unit that is sturdy enough to be used for fanning. The surface area of the fan may be imprinted with indicia, for viewing during fanning or as a display.

17 Claims, 2 Drawing Sheets

FLAT FOLDING FAN WITH ENVELOPE HANDLE

BACKGROUND OF THE INVENTION

1. Field of the Invention

The present invention relates to a hand fan and more particularly to one which unfolds from a flat envelope while remaining attached to it wherein the envelope is used as the handle of the fan.

2. Prior Art

Using a hand fan to circulate air and evaporate moisture from the skin dates back to early history. However, in our modern society hand fans are seldom used because they are considered out of fashion and inconvenient to carry. Electric fans and air conditioners are now relied upon to provide indoor cooling, but in outdoor areas and places where such technology is not in use people can suffer from excessive heat. People do not usually carry a hand fan with their everyday attire and so use other methods to stir a breeze such as waving papers, programs, menus, hats and other convenient devices. If a fan could fit into the window sleeve of a wallet a person would carry it unobtrusively along with their essential identification and so have it at hand whenever needed.

Other items are designed to fit into these window sleeves such as credit cards, driver's licenses, calculators, address books, and magnifying lenses, but no such fans are known.

SUMMARY OF THE INVENTION

The present invention is directed to providing a fan device comprising two flat leaves inseparably attached to a flat hollow handle that serves as an envelope wherein the folded leaves can be tucked away when not in use. The fan can be made small enough that when contained within its envelope/handle the device can be inserted into the window sleeve of a standard wallet or carried in a shirt pocket. The fan opens for use by telescoping the leaves out of the envelope/handle part way and unfolding them and then inserting side tabs of the leaves into side slots on the envelope/handle. The top center notches on both leaves are then interlocked forming a rigid plane comprising the two leaves joined to each other and to the envelope/handle to become a unit that is sturdy enough to be used for fanning and yet will withstand repeated use. The surface area of the entire fan both front and back may be imprinted with indicia to be viewed when using the device for fanning or as a display. The preferred material of construction is inexpensive card stock with a metal fastener, but the fan can be constructed of a variety of other materials.

DETAILED DESCRIPTION

Figure 1:
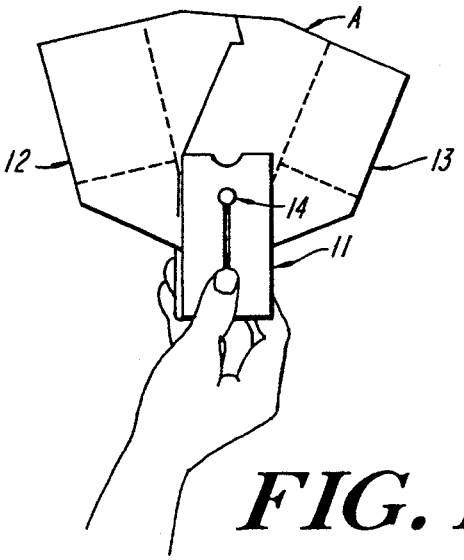
FIG. 1 is an elevational front view of an open fan embodying the invention.
Figure 1A:
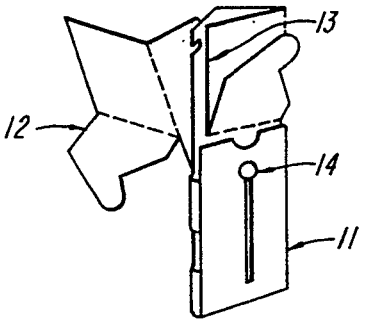
FIG. 1A is a perspective view of a fan of FIG. 1 in a partially folded condition.

Hand fan A (FIG. 1) embodying the invention comprises a left leaf 12, right leaf 13 and an envelope/handle 11 held together with a fastening device 14. When opened and interlocked the sections together are to be known as the open fan. When the sections are folded and enclosed within the envelope/handle it is to be known as the closed fan. "As shown in FIGS. 1 and 1A, each of leaves 12, 13, when unfolded, has a width about twice that of envelope/handle 11, and the overall width of the open fan is about four times that of the envelope/handle.⇄

According to the present invention the manufacture of the fan is simple and can be produced at low cost by means of manufacturing methods. The blanks comprising left leaf 12 and right leaf 13 and envelope/handle 11 can be die cut having all design elements such as notches 18, 19, 25, 26, 35, and 37 slots 17, 24, 36, 38, and 45; and tabs 20, 27, and 50 cut at once and having score lines 15, 16, 22, 23, 29, 30, 31, 32, 33, and 34 impressed into the blanks.

Figures 2, 3:
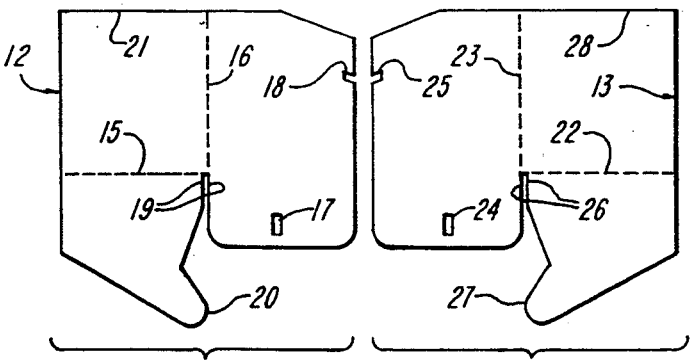
FIG. 2 illustrates the blank from which the section known as the left leaf is to be made.
FIG. 3 illustrates the blank from which the section known as the right leaf is to be made.
Figure 5:
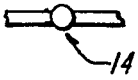
FIG. 5 shows a fastening device of the two prong metal type with domed top.
Figure 4:
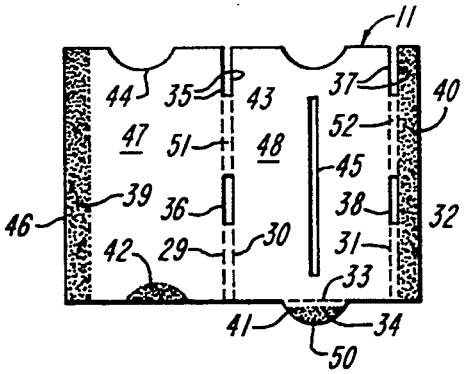
FIG. 4 illustrates the blank from which the section known as the envelope/handle is to be made.
Figure 6:
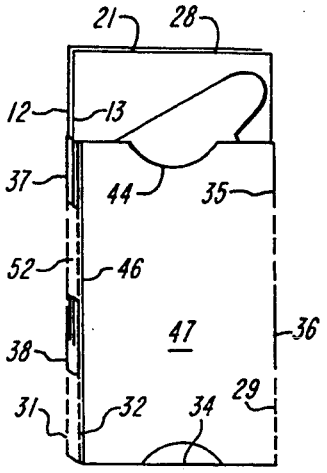
FIG. 6 is a perspective view of the closed fan showing the right panel and back panel with partially extended leaves.

The sections of the fan are assembled by first inserting preferred metal fastener device 14 (FIG. 5) through slot 45 of envelope/handle 11 (FIG. 4) and through slot 24 of right leaf 13 (FIG. 3) and then through slot 17 of left leaf 12 (FIG. 2) and secured behind left leaf 12 by opening the prongs of metal fastener 14 into a flat configuration which will allow movement up and down slot 45. With fastener 14 positioned at top of slot 45 the envelope/handle 11 can be folded at score lines 29, 30, 31, and 32 and wrapped around lower portion of the leaves until outside edge 46 is even to and in line with score line 32 and secured with adhesive within the bounds of areas 39 and 40 (FIG. 6). Lower tab 50 of envelope/handle 11 is folded at score lines 33 and 34 and secured with adhesive within the bounds of areas 41 and 42 (FIG. 6). The envelope/handle 11 is now closed forming back panel 47, front panel 48, left side panel 51 and right side panel 52. The left leaf 12 is folded up at score line 15 and in at score line 16 and the right leaf 13 is folded up at score line 22 and in at score line 23 (FIG. 1A) and the folded leaves are pushed down into envelope/handle 11 until the metal fastener 14 is at the bottom of slot 45 and leaves are concealed and protected within (FIG. 7).

Figure 7:
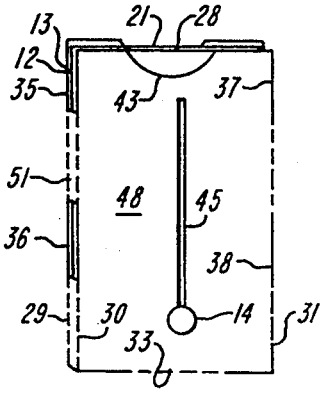
FIG. 7 is a perspective view of the closed fan showing the left panel and front panel.
Figure 8:
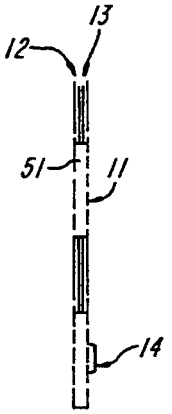
FIG. 8 is an elevational view of the closed fan showing the left side panel.
Figure 9:
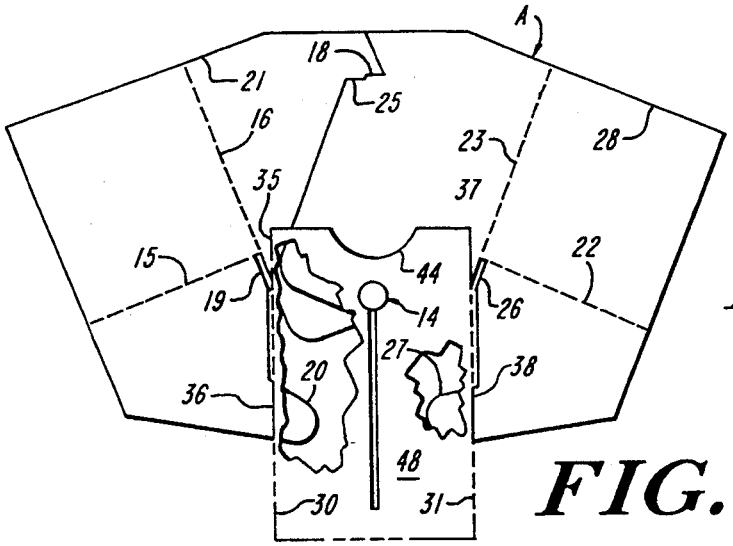
FIG. 9 is an enlarged elevational front view of the open fan of FIG. 1 in part broken away to reveal structural details.

To open the fan, grasp left leaf 12 at upper edge where it is revealed in opening 44 of back panel 47 and right leaf 13 at upper edge 28 where it is revealed in opening 43 of front panel 48 and pull up until metal fastener 14 is at the top of slot 45 (FIG. 7). Unfold and pivot left leaf 12 to the left side and insert tab 20 into slot 36 on left side panel 51 of envelope/handle 11 (FIG. 9). Unfold and pivot right leaf 13 to the right side and insert tab 27 into slot 38 on right side panel 52 of envelope/-handle 11 (FIG. 9). The notch 19 on left leaf 12 will rest in slot 35 of left side panel 51 of envelope/handle 11 and the notch 26 on right leaf 13 will rest in slot 37 of right side panel 52 of envelope/handle 11 supporting and restricting the spread of the leaf sections 12 and 13 (FIG. 9). Interlock fan leaves together by bringing top center of left leaf 12 forward at notch 18 and pushing top center of right leaf 13 back at notch 25 causing tab 20 of left leaf 12 to be pressed fully into slot 36 of left side panel 51 and causing tab 27 of right leaf 13 to be pressed fully into slot 38 of right side panel 52 forming a singular rigid plane comprising left leaf 12, right leaf 13 and envelope/handle 11 (FIG. 9). Thus fan A is ready to be used as display or can be grasped at the lower portion of the envelope/handle (FIG. 1) and used vigorously for fanning.

To close, release the top center notches by pushing top center of left leaf 12 back at notch 18 and bringing top center of right leaf 13 forward at notch 25. This will enable tab 20 of left leaf 12 to be removed from slot 36 of left side panel 51 and tab 27 of right leaf 13 to be removed from slot 38 of right side panel 52. Fold left leaf 12 up at score line 15 and in at score line 16 and fold right leaf 13 up at score line 22 and in at score line 23 and push folded leaves down inside the envelope/handle until fastener 14 is at the bottom of slot 45 of front panel 48 and the fan will be concealed within the envelope/handle 11 (FIG. 7).

In a best mode of construction the fan sections comprising left leaf 12, right leaf 13, and envelope/handle 11 are adapted to be made from blanks of suitable sheet material, such as card stock, self-sustaining plastic and paper or paperboard laminates and the like. Envelope/-handle 11 may also be made of a material other than what is used for the fan leaves 12 and 13, such as plastic, wood, metal or paper composit or any other suitable material. Preferred fastener 14 is a metal fastener with two prongs, however any fastener or rivet of metal, plastic or other suitable material may be used.

Figure 10A:
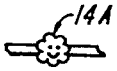
FIG. 10A illustrates a modified fastening device of FIG. 5.
Figure 10:
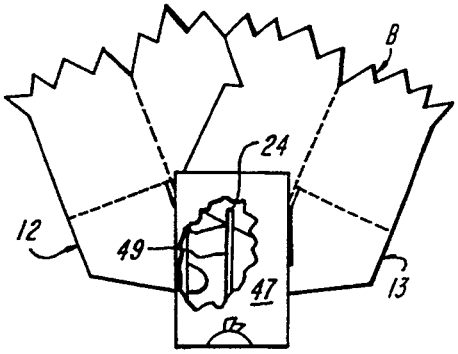
FIG. 10 is an elevational back view of modified open fan showing extra long leaves of irregular shape and in part broken away to reveal modified structural details.
Figure 10B:
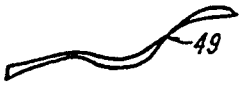
FIG. 10B is a modified fastening device of ribbon which is used in fan of FIG. 10.
Figure 10C:
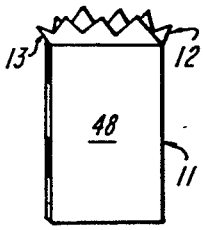
FIG. 10C illustrates front of closed fan of FIG. 10.

Other shapes than shown may be provided for the fan leaves as illustrated on fan B (FIG. 10) where the left leaf 12 and right leaf 13 are of irregular outline although the fan leaves may be provided with any other preferred shape such as floral, animal, or cartoon shapes having dimensions that allow for closure into envelope/handle 11 although a portion of the leaves may extend beyond the top opening if desired (FIG. 10C).

Other shapes than shown may be provided for the exposed head of the fastener 14A (FIG. 10A) such as a flower, balloon, face or any others.

Other modes of fastening leaves 12 and 13 into the envelope/handle 11 may comprise ribbon 49 (FIG. 10B) or other devices applied in a manner to restrict and secure the extension of the leaves, such as shown in fan B (FIG. 10). Pre-measured ribbon 49 (FIG. 10B) can be hidden within the envelope/handle 11 by inserting first through slot 24 of right leaf 13 then through slot 17 of left leaf 12 and securing the ends with adhesive to tab 50 of front panel 48 before joining tab 50 to back panel 47 with adhesive applied within the bounds of area 41 and area 42. This variation works best when envelope/handle is constructed of a modified material that will not flex such as plastic, wood, or metal.

Other objects, features and advantages of the invention will be readily apparent from the previous description of certain representative embodiments thereof, taken in conjunction with the accompanying drawing although variations and modifications may be effected without departing from the spirit and scope of the novel concepts embodied in the disclosure.

What is claimed is:

1. A folding fan comprising:

a longitudinally-extending sleeve defining a cavity open at the top; and, a pair of fan leaves mounted at least partially within said cavity and movable relative to said sleeve, each of said leaves having an overall width greater than the width of said sleeve and including a longitudinal fold line along which the said leaf may be folded so that the sides thereof on opposite sides of the longitudinal fold line thereof overlie each other and the effective width thereof when folded along said longitudinal fold line is not greater than the width of said sleeve, a portion of the side of each of said leaves on one side of the longitudinal fold line thereof being within said cavity and said portions partially overlying each other, a side of each of said leaves being attached to said sleeve, and each said leaf being movable longitudinally relative to said sleeve between an extended position in which both more than half of the said side thereof that is attached to said sleeve and the side thereof on the other side of said longitudinal fold line thereof are outside said sleeve cavity, and a retracted position in which the said leaf is folded along said longitudinal fold line and more than half of both sides thereof are within said cavity.

2. The fan of claim 1 wherein said cavity is generally rectangular in transverse cross-section.

3. The fan of claim 1 wherein the said side of said leaf on the other side of said longitudinal fold line thereof includes a transverse fold line along which the said side may be folded so that the portions of the said on opposite sides of said transverse fold line overlie each other.

4. The fan of claim 3 wherein when said leaves are in said extended position and the said longitudinal fold lines thereof are substantially parallel to said sleeve cavity, said transverse fold lines are positioned above the top of said sleeve and said cavity.

5. The fan of claim 3 wherein said leaves are rotatable relative to each other when in said extended position between a first relative position in which said longitudinal fold lines thereof are substantially parallel to each other and a second relative position in which said longitudinal fold lines thereof diverge.

6. The fan of claim 5 wherein portions of said sleeve defining opposite sides of said cavity each include a recess extending downwardly from the top of a said side, and wherein a portion of each of said leaves is positioned within a respective one of said recesses when said leaves are in said second relative position.

7. The fan of claim 6 wherein an edge of each of said leaves abuts the bottom of a said recess when said leaves are in said second relative position.

8. The fan of claim 6 wherein each of said leaves includes a projecting tab and each of said portions of said sleeve includes a second recess, each of said tabs being arranged to project into a said second recess when said leaves are in said second relative position.

9. The fan of claim 5 wherein an edge of each of said leaves is nearest the other of said leaves when said leaves are in said second relative position and includes a recess arranged to engage the said recess in the said edge of the other of said leaves.

10. The fan of claim 1 wherein said leaves are rotatable relative to each other when in said extended position between a first relative position in which said longitudinal fold lines thereof are substantially parallel to each other and a second relative position in which said longitudinal fold lines diverge.

11. The fan of claim 10 wherein portions of said sleeve defining opposite sides of said cavity each include a recess extending downwardly from the top of a said side, and wherein a portion of each of said leaves is positioned within a respective one of said recesses when said leaves are in said second relative position, each of said portions of said sleeve includes a second recess, and each of said leaves includes a projecting tab arranged to project into a said second recess when said leaves are in said second relative position.

12. The fan of claim 10 wherein an edge of each of said leaves is nearest the other of said leaves when said leaves are in said second relative position and includes a recess arranged to engage the said recess in the said edge of the other of said leaves when said leaves are in said second relative position.

13. The fan of claim 1 including wherein a flexible member attaches said sleeve to said leaves.

14. The fan of claim 1 wherein a longitudinally-extending slot in a wall of said sleeve extends from a point adjacent but spaced from the top thereof to a point adjacent but spaced from the bottom thereof, and a substantially rigid attachment member extends from the exterior of said sleeve through said slot and is attached to both of said leaves, movement of said member within said slot permitting said movement of said leaves between said retracted and extended positions thereof.

15. A flat folding fan comprising:

a longitudinally-extending sleeve defining a generally rectangular in cross-section cavity open at the top; and, a pair of fan leaves mounted at least partially within said cavity, portions of said fan leaves within and adjacent the top of said cavity at least partially overlapping each other, and each of said leaves being attached to said sleeve, each of said leaves having an overall width greater than the width of said sleeve and including a longitudinal fold line along which said leaf may be folded so that the sides on opposite sides of the said longitudinal fold line thereof overlie each other and the effective width when folded along said longitudinal fold line is not greater than the width of said sleeve, a portion of the side of each of said leaves on one side of the longitudinal fold line thereof being within said cavity and attached to said sleeve, the side of each of said leaves on the other side of said longitudinal fold line thereof including a transverse fold line along which the said side may be folded so that the portions of the said side on opposite sides of said transverse fold line overlie each other, and each of said leaves being movable longitudinally relative to said sleeve between an extended position in which both more than half of the said side of said leaf that is attached to said sleeve and the side of said leaf on the other side of said longitudinal fold line thereof are outside said cavity, and a retracted position in which said leaf is folded along both said longitudinal fold line and said transverse fold line thereof and more than half of both of said sides thereof are within said cavity.

16. The fan of claim 15 wherein the overall width of said fan, when said leaves are in said extended position and both of said leaves are positioned in substantially the same plane with neither of said leaves folded along either said longitudinal fold line or said transverse fold line, is about four times the overall width of said fan in said retracted position.

17. A folding fan comprising:

a first generally planar blank having four generally parallel, longitudinally extending fold lines, said first blank being folded along said fold lines to form a generally rectangular sleeve, two generally planar blanks each having a longitudinally extending fold line extending the full height thereof, and a transverse fold line extending from the longitudinally-extending fold line thereof to an edge thereof, the portion of each of said two generally planar blanks on the side of said fold line thereof that does not include the transverse fold line thereof being positioned partially within and being attached to said sleeve such that each of said two generally planar blanks is movable relative to said sleeve in a direction generally parallel to the longitudinal fold lines of said sleeve.

* * * * *

UNITED STATES PATENT AND TRADEMARK OFFICE

CERTIFICATE OF CORRECTION

PATENT NO. : 5,387,084

DATED : February 7, 1995

INVENTOR(S) : Gretchen G. Walberg

It is certified that error appears in the above—identified patent and that said Letters Patent is hereby corrected as shown below:

Column 2, line 31, remove double arrows after "handle."

Column 4, line 42, claim 3, after "said" insert --side--.

Column 5, line 44, claim 15, after "leaves" insert --being--.

Column 5, line 45, claim 15, after "cavity" insert --and--.

Signed and Sealed this

Second Day of May, 1995

Bruce Lehman

*Attest:*

BRUCE LEHMAN

*Attesting Officer*

*Commissioner of Patents and Trademarks*